US008902109B2

(12) United States Patent
Chiang et al.

(10) Patent No.: US 8,902,109 B2
(45) Date of Patent: Dec. 2, 2014

(54) COMMUNICATION DEVICE

(75) Inventors: Chi-Ming Chiang, Taoyuan County (TW); Chun-Chuan Chang, Keelung (TW)

(73) Assignee: Auden Techno Corp., Taoyuan County (TW)

( * ) Notice: Subject to any disclaimer, the term of this patent is extended or adjusted under 35 U.S.C. 154(b) by 161 days.

(21) Appl. No.: 13/366,342

(22) Filed: Feb. 5, 2012

(65) Prior Publication Data

US 2013/0201061 A1 Aug. 8, 2013

(51) Int. Cl.
*H01Q 1/24* (2006.01)
*H01Q 21/00* (2006.01)

(52) U.S. Cl.
USPC ..... 343/702; 343/893

(58) Field of Classification Search
CPC ..... H01Q 1/243; H01Q 1/38; H01Q 9/40; H01Q 5/0051; H01Q 5/0027; H01Q 5/0062
USPC ..... 343/702, 893
See application file for complete search history.

(56) References Cited

U.S. PATENT DOCUMENTS 6,380,903 B1 * 4/2002 Hayes et al. ..... 343/725
6,650,294 B2 * 11/2003 Ying et al. ..... 343/700 MS
6,856,819 B2 * 2/2005 Itoh ..... 455/575.7
7,081,853 B2 * 7/2006 Amano et al. ..... 343/702
7,119,748 B2 * 10/2006 Autti ..... 343/702
7,616,158 B2 * 11/2009 Mak et al. ..... 343/700 MS
7,764,236 B2 * 7/2010 Hill et al. ..... 343/702
7,782,261 B2 * 8/2010 An et al. ..... 343/702
2004/0046701 A1 * 3/2004 Huber et al. ..... 343/702
2004/0125029 A1 * 7/2004 Maoz et al. ..... 343/702
2006/0017624 A1 * 1/2006 Nagano et al. ..... 343/702
2006/0214857 A1 * 9/2006 Ollikainen ..... 343/702

* cited by examiner

*Primary Examiner* — Dameon E Levi
*Assistant Examiner* — Hasan Islam
(74) *Attorney, Agent, or Firm* — Li & Cai Intellectual Property (USA) Office

(57) ABSTRACT

A communication device includes a assembly and an antenna structure formed on the assembly. The antenna structure has a feeding antenna and a stub antenna spaced apart from the feeding antenna. The feeding antenna has a feeding portion. The stub antenna is suitable for being excited and coupled by the feeding antenna, resonating at a resonance frequency of the feeding antenna, and causing the antenna structure to form two hotspots in an operated frequency band. The shortest distance between the feeding antenna and the stub antenna is defined as a coupling distance. The coupling distance is larger than zero and smaller than or equal to the length of the stub antenna. Thus, electric field value generated from the feeding antenna can be reduced by the stub antenna being excited and coupled by the feeding antenna and resonating at the resonance frequency of the feeding antenna.

10 Claims, 10 Drawing Sheets

COMMUNICATION DEVICE

BACKGROUND OF THE INVENTION

1. Field of the Invention

The instant disclosure relates to a communication device; and more particularly, to a communication device having a stub antenna.

2. Description of Related Art

With the wireless communication technology continues to improve, nowadays the personal electronic products are typically equipped with antenna structures. However, the electromagnetic waves of the electronic products will interfere with other electronic devices and will damage the user's brain. Thus, how to reduce the electromagnetic interference and SAR (Specific Absorption Rate) value of the antenna design is a very important subject.

Currently, SAR value of the standard of the Federal Communications Commission (FCC) specification must be less than 1.6 W/Kg. The user's health is the most important thing, so a good electronic product must have low SAR value for its antenna design to gain acceptance by a country's commercial market.

In addition, FIG. 5 shows one type of the conventional antenna structure 1*a*. The conventional antenna structure 1*a* is a feeding antenna used for feeding the signal, which has a feeding portion 11*a* and a grounding portion 12*a*.

When the conventional antenna structure 1*a* is put in use, it will form a single hotspot 13*a*, and the measured data of the conventional antenna structure 1*a* is shown in the table below.

| | | |
|---|---|---|
| 1850 MHz | E | 55.75 V/m |
| | SAR | 1.63 mW/g |

The measured data shows the SAR value of the conventional antenna structure 1*a* can't meet the current international standard. Thus, how to further reduce SAR value of the antenna structure to let the user operates the antenna structure in a more secured environment has become an important issue.

SUMMARY OF THE INVENTION

One object of the instant disclosure is to provide a communication device, where the electric field value generated from the feeding antenna is reduced by coupling and resonating with the stub antenna.

The communication device in accordance with the instant disclosure includes an assembly and an antenna structure formed thereon. The antenna structure has a feeding antenna having a feeding portion and a stub antenna spaced apart from the feeding antenna. The stub antenna is suitable for being excited and coupled by the feeding antenna, resonating at a resonance frequency of the feeding antenna, and causing the antenna structure to have two hotspots in an operated frequency band. A shortest distance between the feeding antenna and the stub antenna is defined as a coupling distance, and the coupling distance is larger than zero and smaller than the length of the stub antenna. An electric field value generated from the feeding antenna is reduced by the stub antenna being excited and coupled by the feeding antenna and resonating at the resonance frequency of the feeding antenna.

Preferably, the feeding antenna and the stub antenna each forms a hotspot.

Preferably, the assembly has an electronic module and a casing corresponding to the electronic module, where the antenna structure is selectively formed on the electronic module and/or the casing.

Preferably, the feeding antenna and the stub antenna are both formed on the electronic module of the assembly.

Preferably, the feeding antenna and the stub antenna are both formed on the casing of the assembly.

Preferably, the feeding antenna of the antenna structure is formed on the electronic module, and the stub antenna of the antenna structure is formed on the casing.

Preferably, the feeding antenna of the antenna structure is formed on the casing, and the stub antenna of the antenna structure is formed on the electronic module.

Preferably, the feeding antenna of the antenna structure is a single-band antenna or a multiple-band antenna.

Preferably, the length of the stub antenna is approximately equal to a half of wavelength at the resonance frequency in the operated frequency band.

Preferably, the coupling distance is larger than zero and smaller or equal to a quarter of the length of the stub antenna.

In conclusion, the instant disclosure provides a communication device capable of effectively reducing the electric field value generated from the feeding antenna by employing the stub antenna, in order to achieve the object of reducing the SAR value of the antenna structure.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

First Embodiment

Figure 1A:
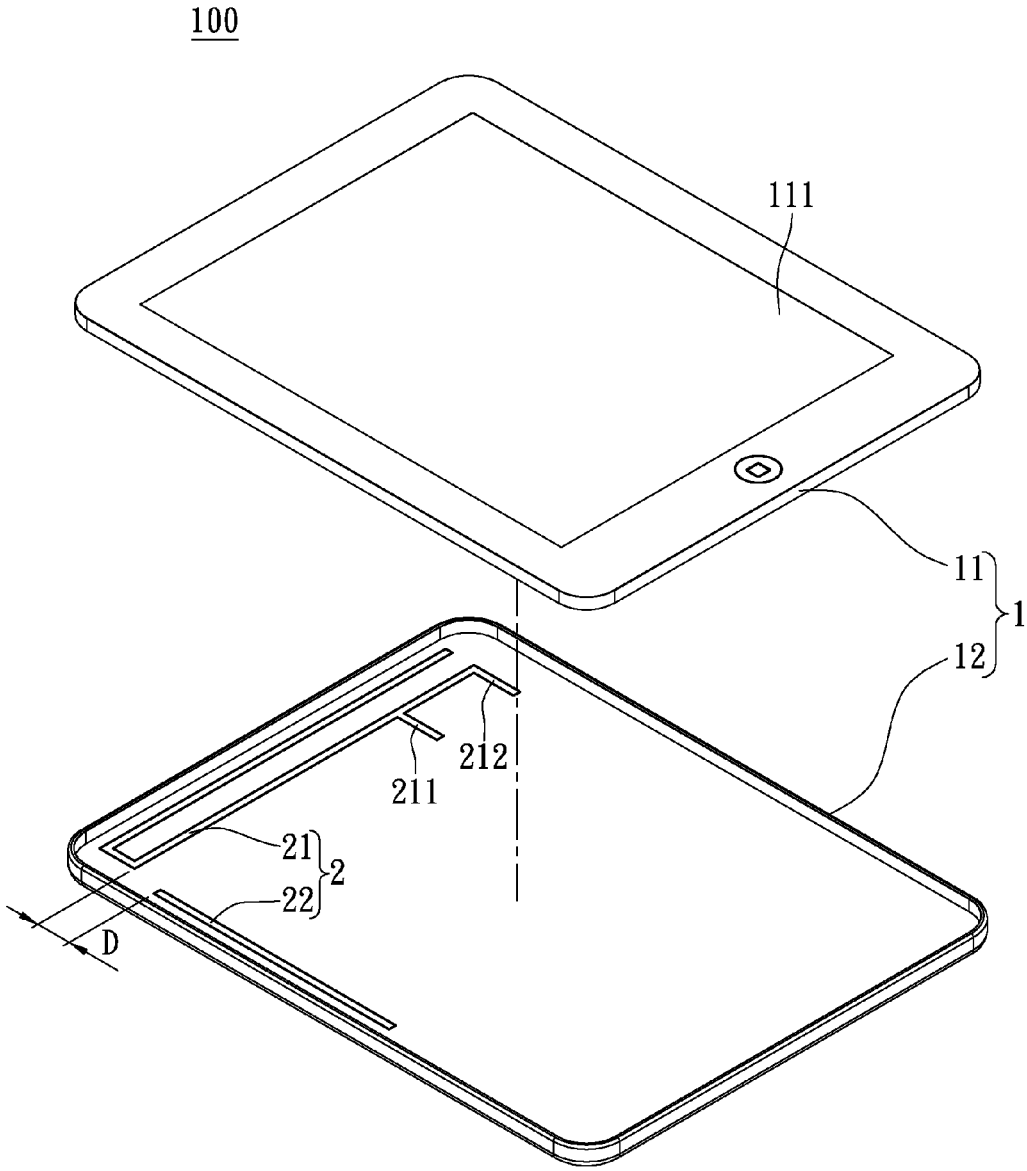
FIG. 1A is an exploded schematic view illustrating the first embodiment of the instant disclosure.
Figure 1B:
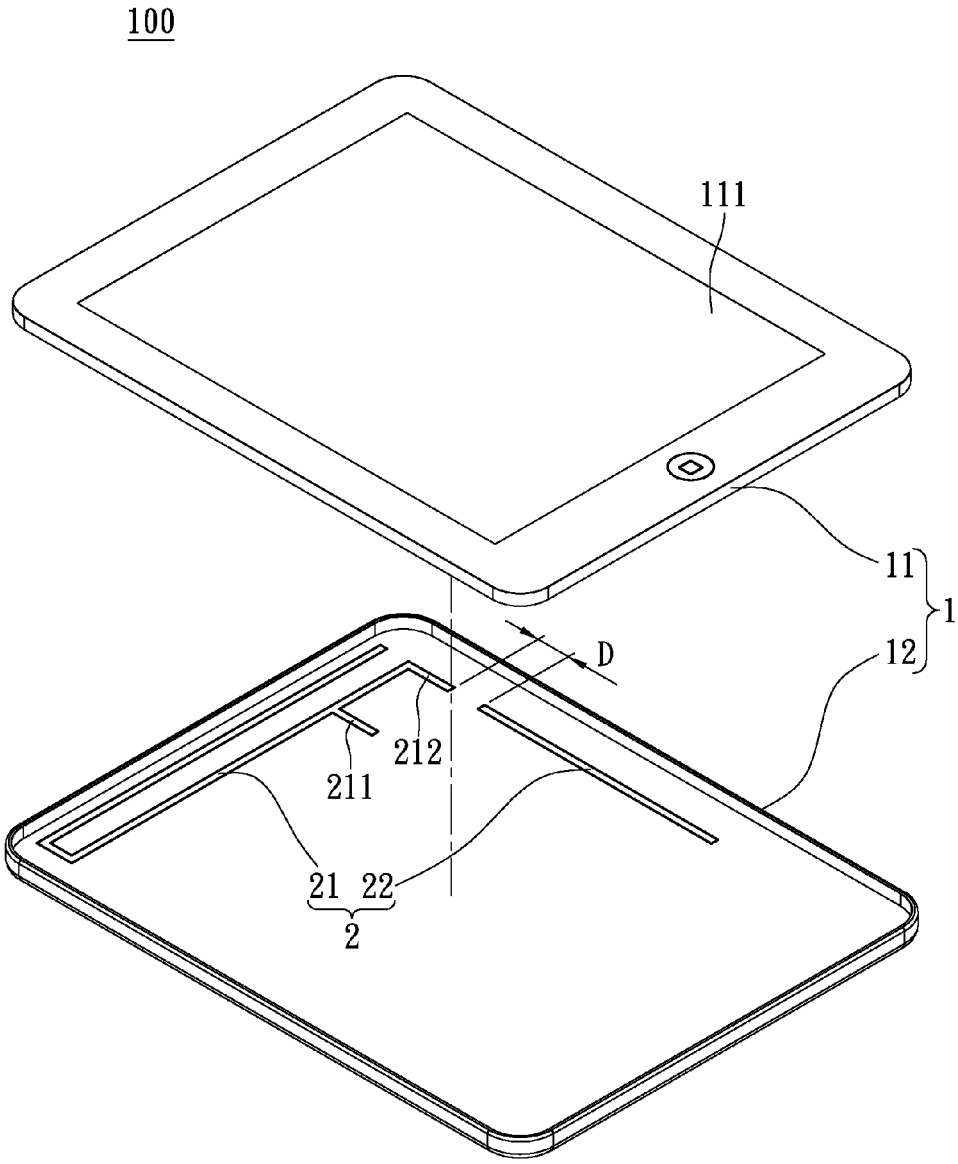
FIG. 1B is an exploded schematic view illustrating another type of the first embodiment of the instant disclosure.
Figure 1C:
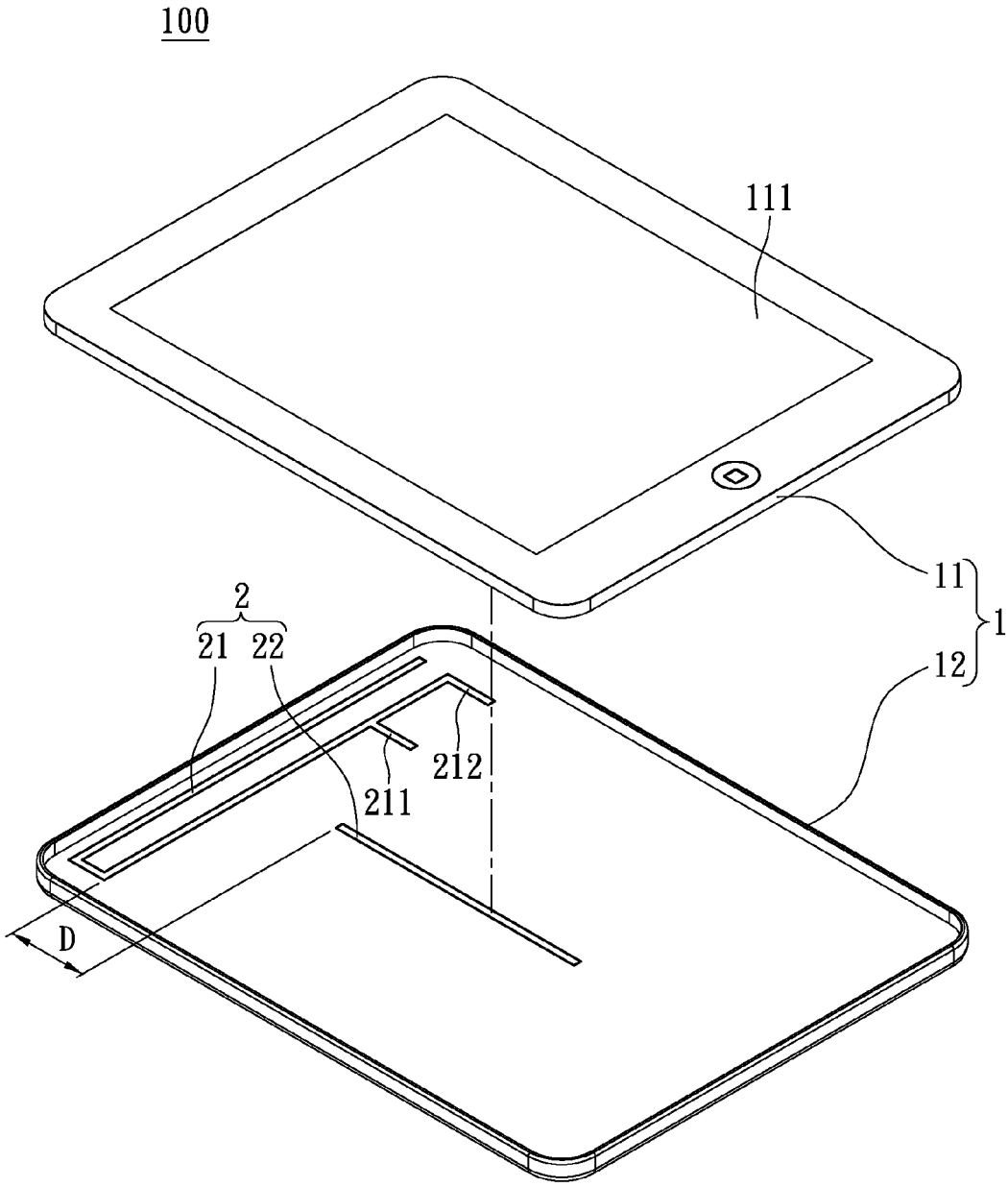
FIG. 1C is an exploded schematic view illustrating further still another type of the first embodiment of the instant disclosure.
Figure 1D:
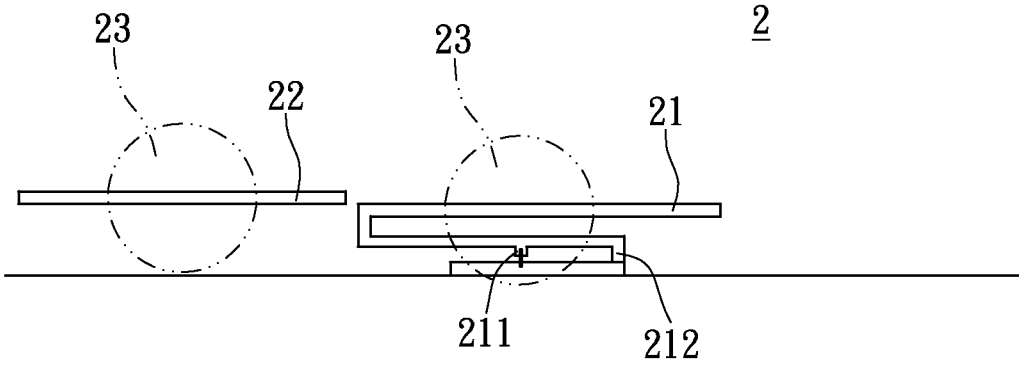
FIG. 1D is a plane schematic view illustrating two hotspots formed on the antenna structure of the first embodiment of the instant disclosure.

Please refer to FIGS. 1A-1D, which show a first embodiment of the instant disclosure, where FIGS. 1A-1C are three-dimensional schematic views, and FIG. 1D is a plane schematic view.

Please refer to FIG. 1A, which shows a communication device 100. The communication device 100 can be a tablet PC, a mobile phone, a smart phone, a personal digital assistant (PDA), or a network card. In this embodiment, the communication device 100 is a tablet PC, but not limited thereto.

The communication device 100 includes an assembly 1 and an antenna structure 2. The antenna structure 2 is formed on the assembly 1.

The assembly 1 has an electronic module 11 and a casing 12. The casing 12 is correspondingly installed to the electronic module 11. In this embodiment, the electronic module 11 is a main body of the tablet PC, and the casing 12 is a casing detachable with the main body of the tablet PC.

The antenna structure 2 has a feeding antenna 21 and a stub antenna 22. The stub antenna 22 is spaced apart from the feeding antenna 21, and the stub antenna 22 couples to the feeding antenna 21 and resonates at a resonance frequency of the feeding antenna 21.

More specifically, the feeding antenna 21 has a feeding portion 211 and at least one grounding portion 212. In this embodiment, the feeding antenna 21 is a dual-band antenna, but not limited thereto. That is to say, the feeding antenna 21 can be a single-band antenna or a multiple-band antenna. Moreover, the stub antenna 22 does not have any feeding portion or any grounding portion, and the stub antenna 22 is solely used for being excited and coupled by the feeding antenna 21, and resonating at the resonance frequency of the feeding antenna 21. In other words, any antenna that has a feeding portion or a grounding portion is not the stub antenna 22 disclosed by the instant disclosure.

In this embodiment, the feeding antenna 21 is a Planar Inverted F Antenna (PIFA), but not limited thereto. That is to say, the feeding antenna 21 can be another antenna type, such as monopole antenna or loop antenna.

Additionally, because the available space of the electronic module 11 is finite, the feeding antenna 21 and the stub antenna 22 are both formed on the casing 12 of the assembly 1. By forming the antenna structure 2 on the casing 12, more available space can be saved for the electronic module 11. Besides, the casing 12 is mainly used as a shelter, thus is inherently able to provide broader space for accommodating the antenna structure 2.

When the casing 12 is covered on the electronic module 11, the feeding antenna 21 of the antenna structure 2 will be electrically connected to the electronic module 11. The means to achieve electrical connection between the feeding antenna 21 and the electronic module 11 is not limited. For example, an signal input source (not shown) can be formed at one portion of the electronic module 11 corresponding to the feeding portion 211 of the feeding antenna 21, and when the casing 12 is covered on the electronic module 11, the feeding portion 211 of the feeding antenna 21 will touch the signal input source, thus achieving the electrical connection between the antenna structure 2 and the electronic module 11.

The manufacturing method of the feeding antenna 21 and the stub antenna 22 is not limited. For example, the feeding antenna 21 and the stub antenna 22 can be formed on the casing 12 by using the Laser Direct Structure (LDS) method.

Moreover, as FIG. 1D shows, the stub antenna 22 is suitable for being excited and coupled by the feeding antenna 21, resonating at the resonance frequency of the feeding antenna 21, and causing the antenna structure 2 in forming two hotspots 23 in an operated frequency band. In other words, two hotspots 23 are formed respectively on the feeding antenna 21 and the stub antenna 22 so as to reduce an electric field value generated from the feeding antenna 21.

A shortest distance between the feeding antenna 21 and the stub antenna 22 is defined as a coupling distance D. The coupling distance D is larger than zero and smaller than or equal to the length of the stub antenna 22. Preferably, the length of the stub antenna 21 is approximately equal to a half of wavelength at the resonance frequency in the operated frequency band. The coupling distance D is preferably greater than zero and smaller than or equal to a quarter of the length of the stub antenna 22.

In other words, under the condition that the length of the stub antenna 22 and the coupling distance D meet the above requirements, the stub antenna 22 can be formed with any shape and at any position, and not limited to the orientations shown in the figures of the instant disclosure. For example, the stub antenna 22 can be changed from the left side of the casing 12 (as shown in FIG. 1A) to the right side (as shown in FIG. 1B) or the central portion (as shown in FIG. 1C).

Besides, in this embodiment, the stub antenna 22 is formed linearly, but not limited thereto. For example, the stub antenna 22 can be L-shaped, wave-shaped, or have any other shape.

Specifically speaking, after simulation test, the antenna structure 2 of the communication device 100 of this embodiment has the result as follows. The antenna structure 2 has two hotspots 23 (as shown in FIG. 1D) to reduce the electric field value generated from the feeding antenna 21, under a resonant frequency range of 1600-2200 MHz. The electric field value (E) and the Specific Absorption Rate (SAR) of the antenna structure 2 measured at 1850 MHz is shown in the following chart.

| | | |
|---|---|---|
| 1850 MHz | E | 40.94 V/m |
| | SAR | 0.92 mW/g |

Thus, the electric field value (E) and the Specific Absorption Rate (SAR) of the antenna structure 2 are 40.94 V/m and 0.92 mW/g, respectively. In other words, the SAR and electric field values of the antenna structure 2 are less versus without the stub antenna 22 (such as 55.75 V/m and 1.63 mW/g of the conventional antenna 1*a*).

In conclusion, the antenna structure 2 can be used to reduce the electric field value (E) generated from the feeding antenna 21 by the stub antenna 22 being excited and coupled by the feeding antenna 21 and resonating at the resonance frequency of the feeding antenna 21, whereby the Specific Absorption Rate (SAR) of the antenna structure 2 can be reduced to provide the user a safer condition for using the communication device 100.

Even if a metal piece (not shown) is disposed adjacent to the stub antenna 22, the antenna structure 2 can still operate normally without interference from the metal piece, and the antenna structure 2 still can be used to reduce the Specific Absorption Rate (SAR).

Second Embodiment

Figure 2A:
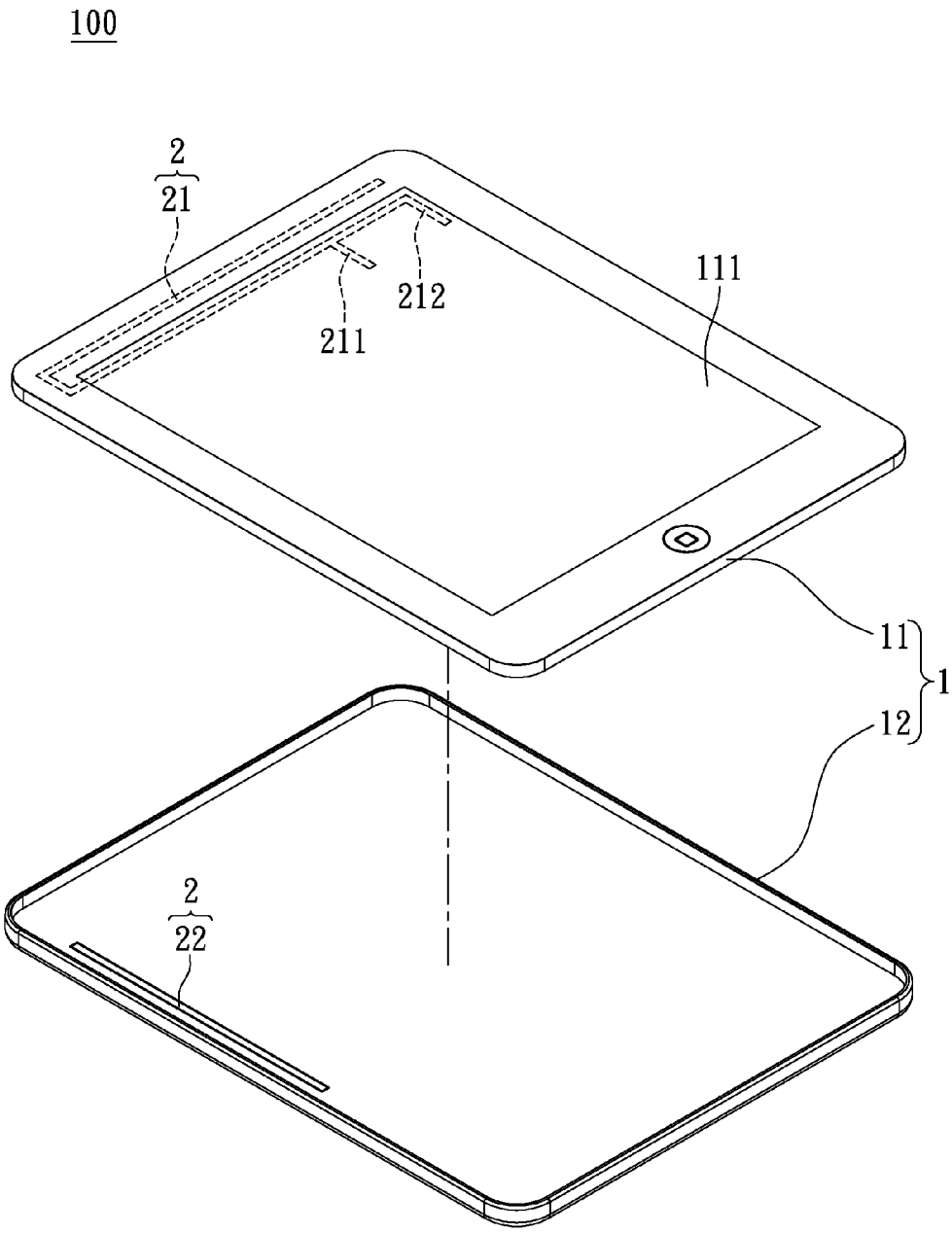
FIG. 2A is an exploded schematic view illustrating the second embodiment of the instant disclosure.
Figure 2B:
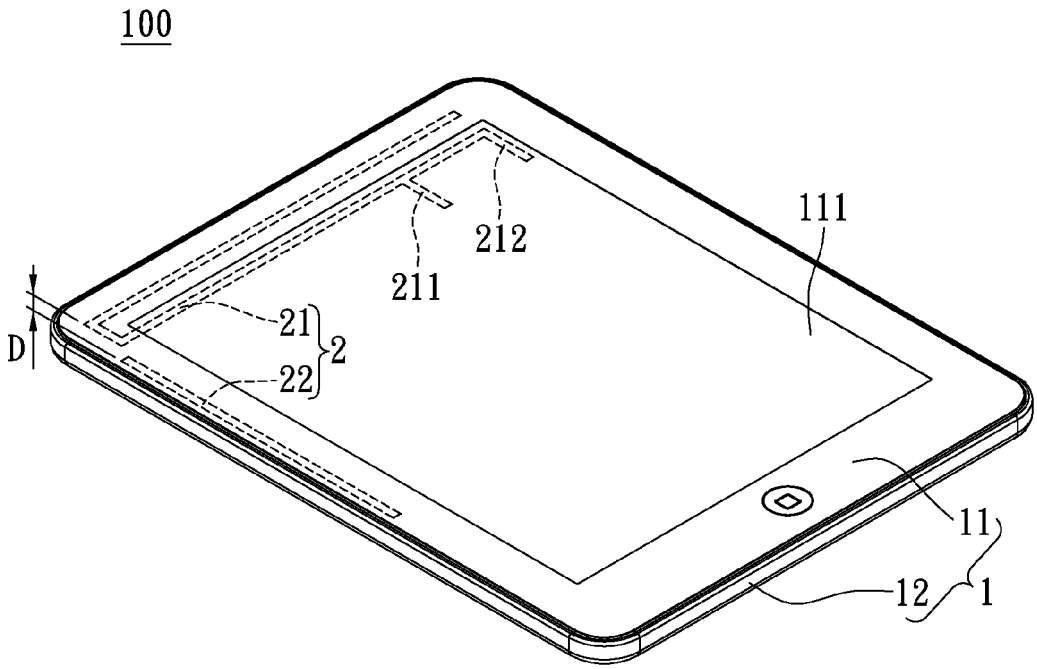
FIG. 2B is an assembled view illustrating the second embodiment of the instant disclosure.

Please refer to FIGS. 2A and 2B, which show a second embodiment of the instant disclosure. The second embodiment is similar to the first embodiment, and the difference between both is that the feeding antenna 21 of the second embodiment is formed on the electronic module 11 of the assembly 1.

More specifically, the feeding antenna 21 is formed on a region of the electronic module 11, which is outside a screen 111 of the electronic module 11, and the region can be changed according to the designer. For example, the feeding antenna 21 can be formed on the circuit board (not shown) of the electronic module 11 or the surface of the insulating body (not shown) of the electronic module 11. Moreover, the feeding antenna 21 is operated by electrically connected to the electronic module 11.

Third Embodiment

Figure 3A:
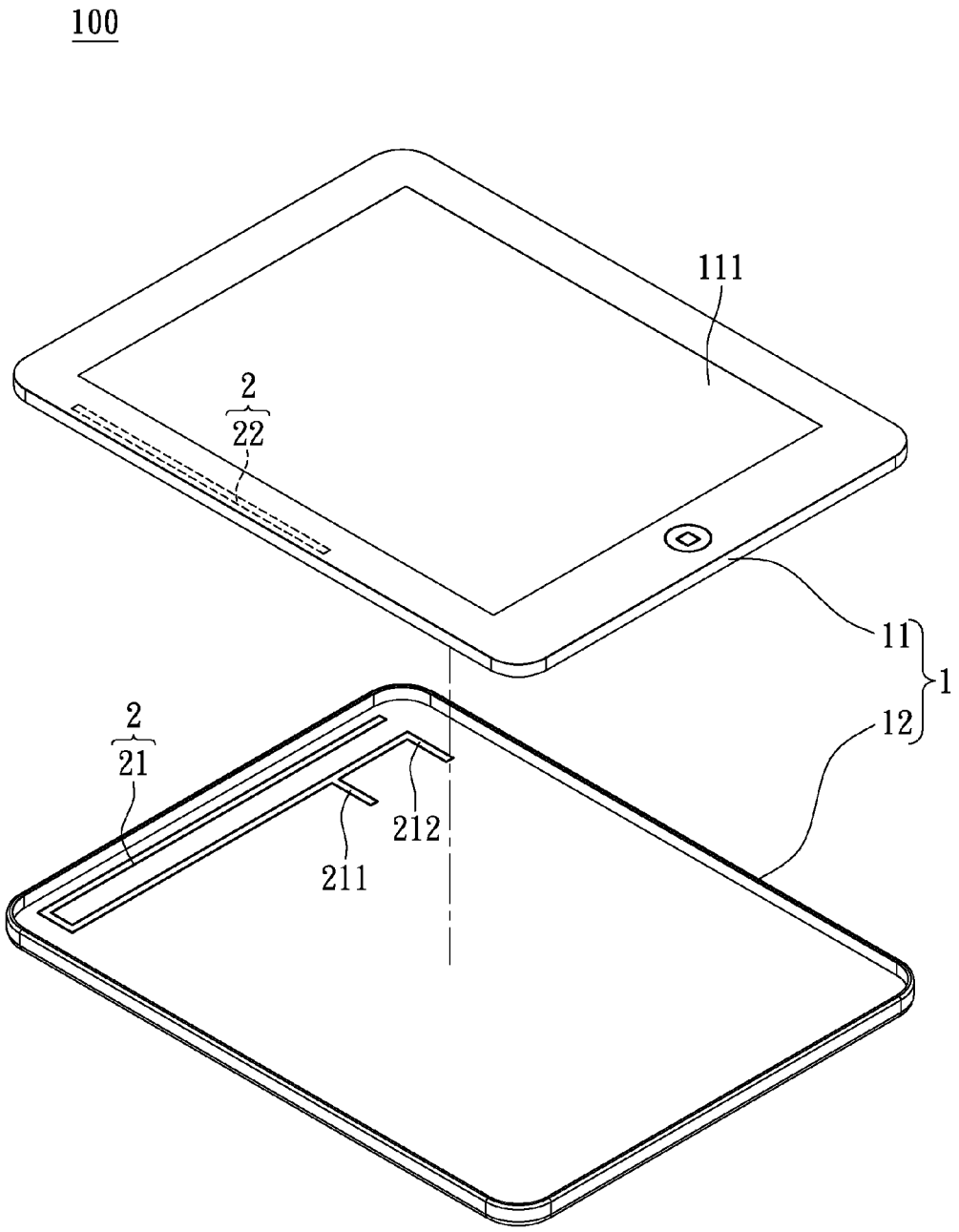
FIG. 3A is an exploded schematic view illustrating the third embodiment of the instant disclosure.
Figure 3B:
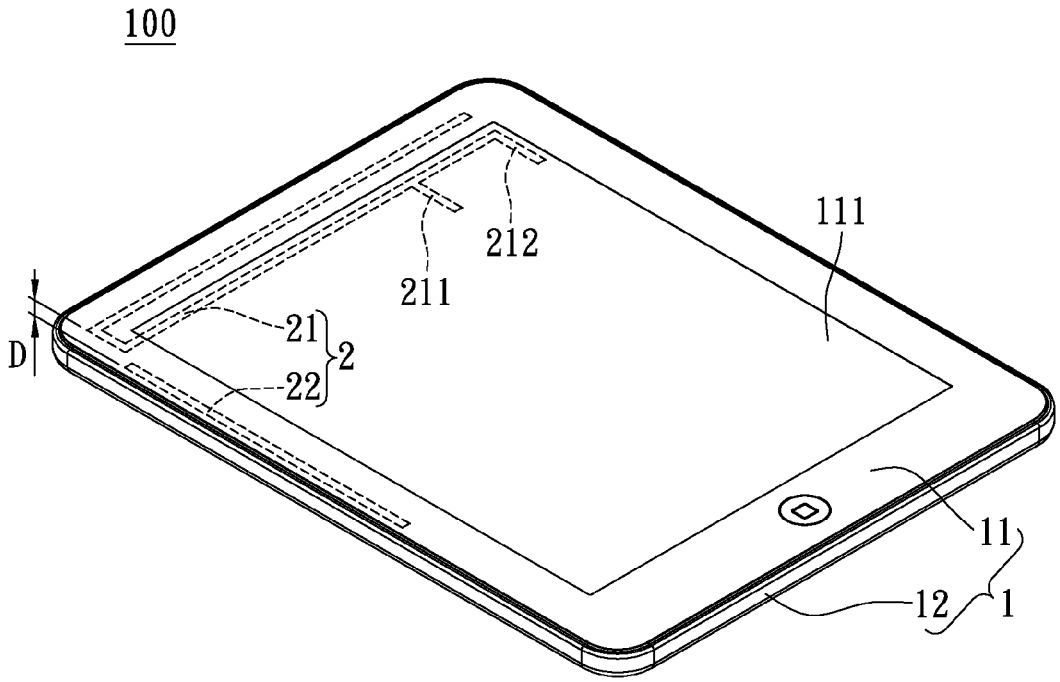
FIG. 3B is an assembled view illustrating the third embodiment of the instant disclosure.

Please refer to FIGS. 3A and 3B, which show a third embodiment of the instant disclosure. The third embodiment is similar to the first embodiment, and the difference between both is that the stub antenna 22 of the second embodiment is formed on the electronic module 11 of the assembly 1.

More specifically, the stub antenna 22 is formed on a region of the electronic module 11, which is outside the screen 111 of the electronic module 11, and the region can be changed according to the designer. For example, the stub antenna 22 can be formed on the circuit board (not shown) of the electronic module 11 or the surface of the insulating body (not shown) of the electronic module 11.

Fourth Embodiment

Figure 4:
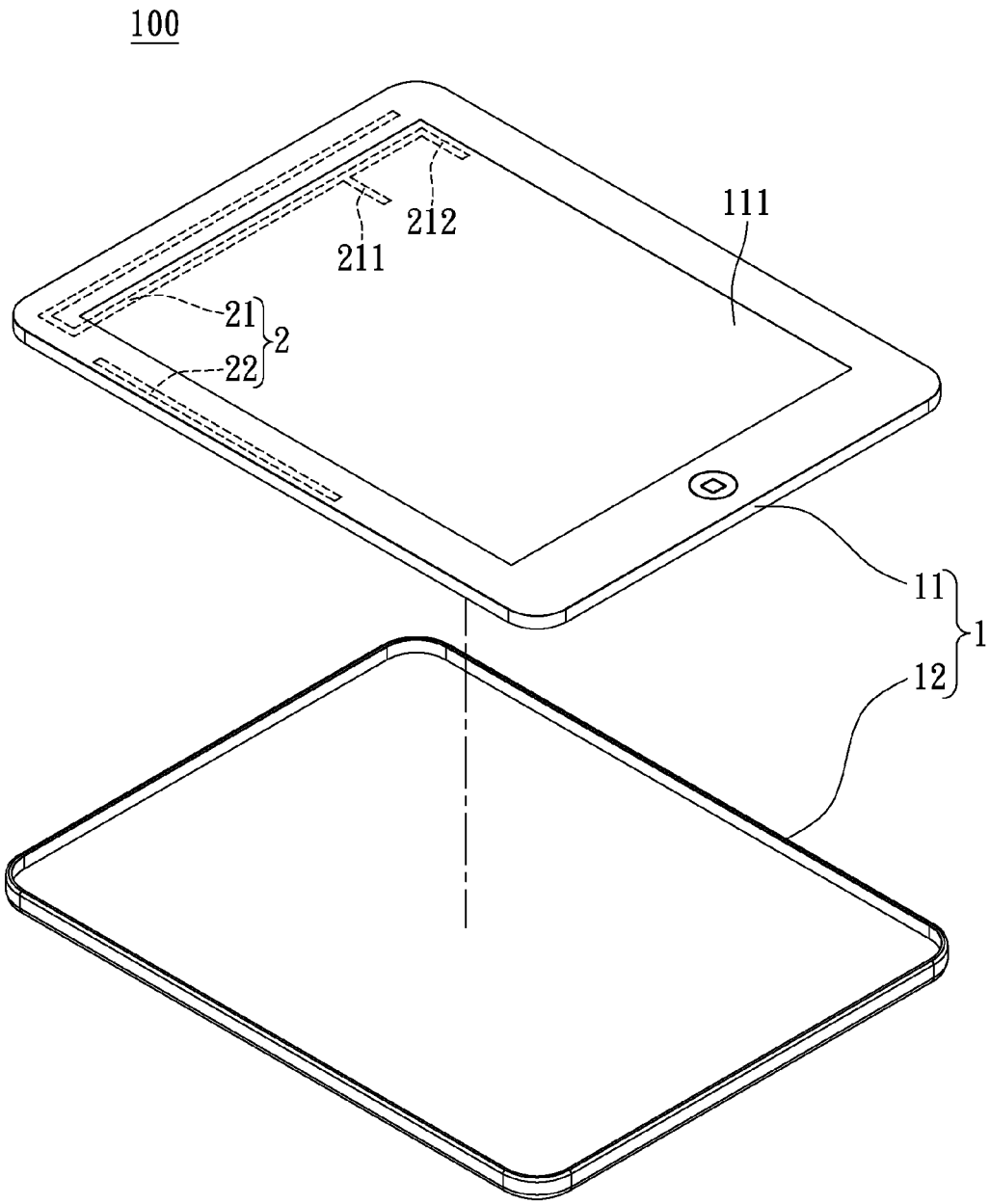
FIG. 4 is a perspective view illustrating the fourth embodiment of the instant disclosure.
Figure 5:
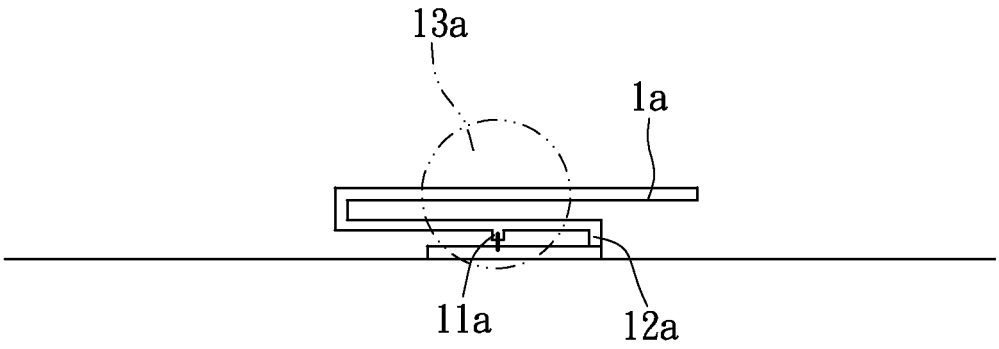
FIG. 5 PRIOR ART
FIG. 5 is a plane schematic view illustrating the conventional antenna structure of the related art.

Please refer to FIG. 4, which shows a fourth embodiment of the instant disclosure. The fourth embodiment is similar to the second and third embodiments, and the difference being the feeding antenna 21 and the stub antenna 22 of the fourth embodiment are both formed on the electronic module 11 of the assembly 1.

Advantages

For the communication device 100, the antenna structure 2 is selectively formed on the electronic module 11 and/or the casing 12. And, the stub antenna 22 is excited and coupled by the feeding antenna 21 and resonating at the resonance frequency of the feeding antenna 21 by the suitable length of the stub antenna 22 and the suitable coupling distance D, thereby causing the antenna structure 2 has two hotspots 23 arranged respectively on the feeding antenna 21 and the stub antenna 22.

Thus, the antenna structure 2 can be used to reduce the electric field value (E) generated from the feeding antenna 21 by the stub antenna 22, whereby the Specific Absorption Rate (SAR) of the antenna structure 2 can be reduced to provide the user a safer condition for using the communication device 100.

The descriptions illustrated supra set forth simply the preferred embodiments of the present invention; however, the characteristics of the instant disclosure are by no means restricted thereto. All changes, alternations, or modifications conveniently considered by those skilled in the art are deemed to be encompassed within the scope of the present invention delineated by the following claims.

What is claimed is:

1. A communication device, comprising:

an assembly having an electronic module and a casing correspondingly installed to the electronic module, wherein each one of the electronic module and the casing defines a first area and a second area spaced apart from the first area thereof, the first area of the casing is defined by orthogonally projecting the first area of the electronic module onto the casing, and the second area of the casing is defined by orthogonally projecting the second area of the electronic module onto the casing; and an antenna structure, fixedly formed on the assembly and arranged in the assembly, having:

a feeding antenna having a feeding portion and at least one grounding portion, wherein the feeding antenna is formed on one of the first areas of the assembly; and a stub antenna, spaced apart from the feeding antenna and configured without feeding portion and grounding portion, wherein the stub antenna is formed on one of the second areas of the assembly, and the relative position of the feeding antenna and the stub antenna is fixed, wherein the stub antenna is suitable for being excited and coupled by the feeding antenna, resonating at a resonance frequency of the feeding antenna, and causing the antenna structure in forming two hotspots in an operated frequency band, wherein a shortest distance between the feeding antenna and the stub antenna is defined as a coupling distance, and the coupling distance is larger than zero and smaller than or equal to the length of the stub antenna, whereby, an electric field value generated from the feeding antenna is reduced by the stub antenna being excited and coupled by the feeding antenna and resonating at the resonance frequency of the feeding antenna, and the feeding antenna formed on one of the first areas and the stub antenna formed on one of the second areas are configured to reduce a specific absorption rate (SAR) of the antenna structure.

2. The communication device as claimed in claim 1, wherein the two hotspots are formed respectively on the feeding antenna and the stub antenna.

3. The communication device as claimed in claim 2, wherein the assembly has an electronic module and a casing corresponding to the electronic module, and wherein the antenna structure is formed on at least one of the electronic module and the casing.

4. The communication device as claimed in claim 3, wherein the feeding antenna and the stub antenna are both formed on the electronic module of the assembly.

5. The communication device as claimed in claim 3, wherein the feeding antenna and the stub antenna are both formed on the casing of the assembly.

6. The communication device as claimed in claim 3, wherein the feeding antenna of the antenna structure is formed on the electronic module and the stub antenna of the antenna structure is formed on the casing.

7. The communication device as claimed in claim 3, wherein the feeding antenna of the antenna structure is formed on the casing and the stub antenna of the antenna structure is formed on the electronic module.

8. The communication device as claimed in claim 1, wherein the feeding antenna of the antenna structure is a single-band antenna or a multiple-band antenna.

9. The communication device as claimed in claim 1, wherein the length of the stub antenna is approximately equal to a half of wavelength at the resonance frequency in the operated frequency band.

10. The communication device as claimed in claim 9, wherein the coupling distance is larger than zero and smaller than or equal to a quarter of the length of the stub antenna.

* * * * *